US009245475B2

(12) United States Patent
Lin et al.

(10) Patent No.: US 9,245,475 B2
(45) Date of Patent: Jan. 26, 2016

(54) DISPLAY PANEL AND DEMULTIPLEXER CIRCUIT THEREOF

(71) Applicant: Au Optronics Corporation, Hsinchu (TW)

(72) Inventors: Chen-Chi Lin, Hsinchu County (TW); Chih-Hsiang Chang, Yunlin County (TW)

(73) Assignee: Au Optronics Corporation, Hsinchu (TW)

( * ) Notice: Subject to any disclaimer, the term of this patent is extended or adjusted under 35 U.S.C. 154(b) by 51 days.

(21) Appl. No.: 14/337,235

(22) Filed: Jul. 22, 2014

(65) Prior Publication Data

US 2015/0213753 A1 Jul. 30, 2015

(30) Foreign Application Priority Data

Jan. 29, 2014 (TW) ..... 103103589 A

(51) Int. Cl.

| | |
|---|---|
| ***G09G 5/00*** | (2006.01) |
| ***G09G 3/20*** | (2006.01) |
| ***G09G 3/32*** | (2006.01) |
| ***G09G 3/36*** | (2006.01) |

(52) U.S. Cl.

CPC ..... *G09G 3/2096* (2013.01); *G09G 3/3275* (2013.01); *G09G 3/3685* (2013.01); *G09G 2310/0213* (2013.01); *G09G 2310/0297* (2013.01); *G09G 2320/043* (2013.01)

(58) Field of Classification Search

CPC ..... G09G 3/3685
USPC ..... 345/204
See application file for complete search history.

(56) References Cited

U.S. PATENT DOCUMENTS

| | | | | |
|---|---|---|---|---|
| 2006/0250332 | A1* | 11/2006 | Lo | G09G 3/20 345/76 |
| 2007/0057877 | A1* | 3/2007 | Choi | G09G 3/3291 345/76 |
| 2009/0195492 | A1* | 8/2009 | Takahashi | G09G 3/3688 345/98 |
| 2009/0273388 | A1* | 11/2009 | Yamashita | G09G 3/3688 327/416 |
| 2013/0038518 | A1* | 2/2013 | Tagawa | G02F 1/1345 345/92 |
| 2013/0147780 | A1* | 6/2013 | Kita | G09G 3/3688 345/211 |
| 2015/0213753 | A1* | 7/2015 | Lin | G09G 3/3685 345/214 |

FOREIGN PATENT DOCUMENTS

| | | |
|---|---|---|
| TW | I405160 | 8/2013 |

* cited by examiner

*Primary Examiner* — Adam J Snyder
(74) *Attorney, Agent, or Firm* — Jianq Chyun IP Office

(57) ABSTRACT

A display panel and a demultiplexer circuit are provided. The demultiplexer circuit includes a first to a Pth switch units. The first to the Pth switch units are coupled to a first to a Pth data lines of a display panel respectively and collectively receive a data voltage and turn on sequentially in sequence to provide the data voltage to corresponding data lines. A period of the first to the Pth switch units provide the data voltage to the first to the P data lines sequentially which is defined to a data transmission period. When the switch unit is turned on, N transistors are turned on simultaneously according to a plurality of control signals. When the switch unit is turned off, at least one of the N transistors is turned off according to a corresponding control signal.

20 Claims, 5 Drawing Sheets

DISPLAY PANEL AND DEMULTIPLEXER CIRCUIT THEREOF

CROSS-REFERENCE TO RELATED APPLICATION

This application claims the priority benefit of Taiwan application serial no. 103103589, filed on Jan. 29, 2014. The entirety of the above-mentioned patent application is hereby incorporated by reference herein and made a part of this specification.

BACKGROUND

1. Field of the Invention

The invention is related to a flat display technology and more particularly, to a display panel and a demultiplexer circuit thereof.

2. Description of Related Art

With progress in manufacturing technologies of semiconductors, volumes of various types of electronic products are also developed toward being light and thin. In other to meet demands for miniaturization of the electronic products, flat panel displays are widely used due to having advantages, such as good space utilization efficiency, high definition, low power consumption, radiation free and so on. Generally, a flat panel display includes elements, such as a backlight module, a display panel and so on. The display panel is composed of pixel arrays, where a source driver transmits data voltages required by the pixel arrays through a plurality of data lines.

In order to resolve an issue of the increase of the number of the data lines due to the increase of the display panel resolution, which leads to the increase of pin numbers of chips of an integrated circuit (IC), a demultiplexer circuit is commonly disposed between the display panel and the source driver. A demultiplexer circuit is typically formed by a plurality of thin film transistors (TFTs). For an N-type TFT, when the TFT is applied with a negative bias voltage for a long time, a stress situation occurs easily. On the other hand, for accurate levels of control signals, a width-to-length ratio of TFT channels is quite large in most cases, and as a result, a stress speed of the TFTs also becomes faster. Therefore, how to mitigate the stress speed for the TFTs in the demultiplexer circuit has become a subject of designing the demultiplexer circuit.

SUMMARY

The invention and embodiments thereof provide a display panel and a demultiplexer circuit thereof capable of reducing a time period in which transistors in the demultiplexer circuit are in a turned off state so as to mitigate a speed of deterioration for the transistors.

The invention is directed to a demultiplexer circuit adapted to transmit a data voltage provided by a source driver to a first to a Pth data lines of a display panel. The demultiplexer circuit includes a first to a Pth switch units. The first to the Pth switch units are respectively electrically coupled to the first to the Pth data lines of the display panel and configured to collectively receive the data voltage and to be turned on in sequence to provide the data voltage to the corresponding data lines. A period of the data voltage being provided to the first to the Pth data lines in sequence is defined as a data transmission period. Each of the switch unit includes a first to a Nth transistors. The N transistors are connected with one another in series and configured to receive a plurality of control signals. When the switch units are turned on, the N transistors are further configured to be turned on simultaneously according to the control signals to transmit the data voltage to the corresponding data lines. When the switch units are turned off, at least one of the N transistors is further configured to be turned off according to the corresponding control signal. N is equal to P−1, and P is an integer greater than 2. In the data transmission period, a time length of each of the control signals having a first voltage is greater than or equal to a time length of each of the control signals having a second voltage, and the first voltage is greater than the second voltage.

In an embodiment of the invention, in the configuration of the first to the Pth switch units collectively receiving the data voltage and being turned on in sequence to provide the data voltage to the corresponding data lines, each of the switch units are configured to transmit the data voltage through the first to the Nth transistors in sequence and provide the data voltage to the corresponding data line.

In an embodiment of the invention, in the data transmission period, the first to the Nth transistors of the Pth switch unit are turned off in a sequence from the first to the Nth transistors.

In an embodiment of the invention, the control signals include a first to a Pth control signals, the first to the Pth control signals are set to have the first voltage as default and are set to have the second voltage in sequence in the data transmission period, and periods for the first to the Pth control signals having the second voltage do not overlap.

In an embodiment of the invention, a jth transistor of an ith switch unit is configured to receive a kth control signal, when a remainder after i+j is divided by P is not equal to 0, k is equal to the remainder after i+j is divided by P, and when the remainder after i+j is divided by P is equal to 0, k is equal to P, wherein i, j and k are respectively integers.

In an embodiment of the invention, P is equal to 3, N is equal to 2. The first and the second transistors of the first switch unit respectively receive the second and the third control signals. The first and the second transistors of the second switch unit respectively receive the third and the first control signals. The first and the second transistors of the third switch unit respectively receive the first and the second control signals.

In an embodiment of the invention, P is equal to 6, N is equal to 5. The first to the fifth transistors of the first switch unit respectively receive the second to the sixth control signals. The first to the fifth transistors of the second switch unit respectively receive the third to the sixth and the first control signals. The first to the fifth transistors of the third switch unit respectively receive the fourth to the sixth and the first to the second control signals. The first to the fifth transistors of the fourth switch unit respectively receive the fifth to the sixth and the first to the third control signals. The first to the fifth transistors of the fifth switch unit respectively receive respectively receive the sixth and the first to the fourth control signals. The first to the fifth transistors of the sixth switch unit receive the first to the fifth control signals in sequence.

The invention is directed to a display panel including a plurality of pixels, a plurality of data lines and a control unit. The of data lines is electrically coupled to the plurality of pixels. A demultiplexer circuit, providing by any one of the embodiments of the invention, is electrically coupled to the plurality of data lines. The control unit is configured to generate a plurality of control signals.

Based on the above, in the display panel and the demultiplexer circuit of the embodiments of the invention, the control signals are reconfigured as the periods having the first voltage or the second voltage, and the circuit structure of the demultiplexer circuit is correspondingly reconfigured, such that a time length of the transistors in the demultiplexer circuit being turned on is greater than or equal to a time length of being turned off. By this way, stress due to the transistors of the demultiplexer circuit being turned off for a long time can be mitigated.

According to anther embodiment of the invention, a demultiplexer circuit adapted to transmit a data voltage provided by a source driver to a first to a Pth data lines of a display panel is provided. The demultiplexer circuit includes a first to a Pth switch units respectively electrically coupled to the first to the Pth data lines of the display panel and configured to collectively receive the data voltage. The first to the Pth switch units are turned on in sequence to provide the data voltage to the corresponding data lines, and a period of the data voltage being provided to the first to the Pth data lines in sequence is defined as a data transmission period. Each of the switch units includes a first to a Nth transistors, the first to the Nth transistors are connected with one another in series from the source driver to the corresponding data lines and configured to receive a plurality of control signals. When the switch units are turned on, the N transistors are further configured to be turned on simultaneously according to the control signals to transmit the data voltage to the corresponding data lines. When the switch units are turned off, at least one of the N transistors is further configured to be turned off according to the corresponding control signal. N is equal to P−1, and P is an integer greater than 2. In the data transmission period, the first to the Nth transistors of the first switch unit are turned off in a sequence from the first to the Nth transistors.

According to anther embodiment of the invention, a display panel is provided. The display panel includes a plurality of pixels, a plurality of data lines electrically coupled to the plurality of pixels, the aforementioned demultiplexer circuit electrically coupled to the plurality of data lines and a control unit configured to generate the plurality of control signals.

Based on the above, the sequence of turning on and off the first to the Nth transistors of the first switch unit of the demultiplexer circuit is adequately configured, such that in follow-up operations of the other switch units, the data line electrically coupled to the first switch unit can be prevented from being provided with wrong signals.

In sequence to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
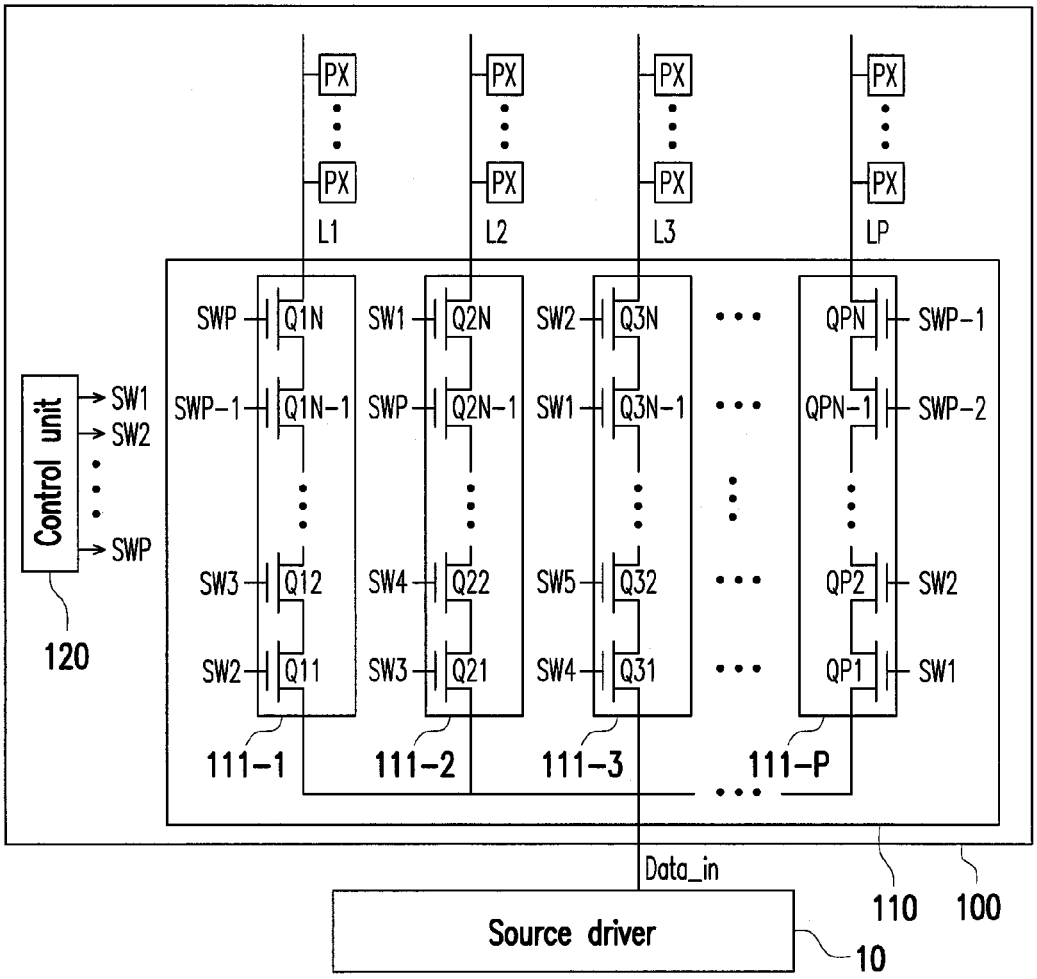
FIG. 1A is a schematic circuit diagram illustrating a display panel according to an embodiment of the invention.
Figure 1B:
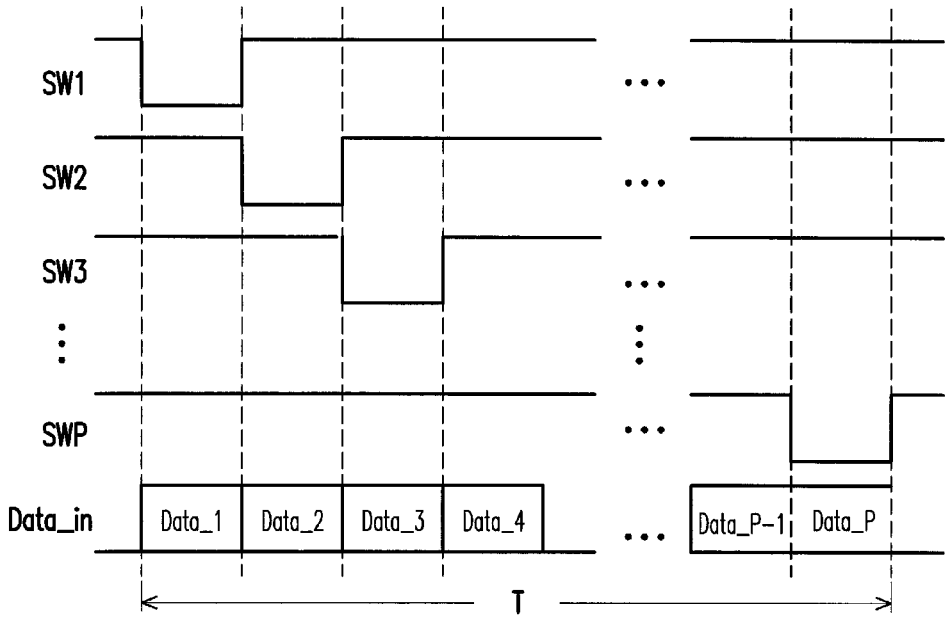
FIG. 1B is a schematic diagram illustrating a drive waveform of the demultiplexer circuit depicted in FIG. 1A.

FIG. 1A is a schematic circuit diagram illustrating a display panel according to an embodiment of the invention. FIG. 1B is a schematic diagram illustrating a drive waveform of the demultiplexer circuit depicted in FIG. 1A. Description with reference to FIG. 1A and FIG. 1B will be set forth below. In the present embodiment, a display panel 100 includes a plurality of pixels PX, a plurality of data lines L1 to LP, a demultiplexer circuit 110 and a control unit 120. The data lines L1 to LP are electrically coupled to the corresponding pixels PX respectively, and the demultiplexer circuit 110 is electrically coupled to the data lines L1 to LP. The demultiplexer circuit 110 is configured to transmit a data voltage Data_in provided by the source driver 10 to the data lines L1 to LP, and the control unit 120 is configured to generate a plurality of control signals SW1 to SWP (corresponding to a first to a Pth control signals) to control a transmission state of the demultiplexer circuit 110. The display panel 100 may be a liquid crystal display (LCD) panel or an organic light-emitting diode (OLED) display panel, but the invention is not limited thereto.

The demultiplexer circuit 110 includes a first to a Pth switch units 111-1 to 111-P. The switch units 111-1 to 111-P are electrically coupled to the data lines L1 to LP of the display panel 100 respectively to collectively receive the data voltage Data_in provided by the source driver 10. The switch units 111-1 to 111-P are turned on in sequence to provide the data voltage Data_in to corresponding data lines among the data lines L1 to LP, and a period of the data voltage Data_in being provided in sequence to the first to the Pth data lines is defined as a data transmission period T. Additionally, in the present embodiment, only one data voltage Data_in is illustrated as exemplary description, but the invention is not intent to limit the number of the data voltage Data_in, and in other embodiments, the source driver 10 may transmit a plurality of data voltages Data_in to the demultiplexer circuit 110.

Each of the switch units 111-1 to 111-P includes a first to a Nth transistors (e.g., transistors Q11 to Q1N, . . . or QP1 to QPN), and the N transistors are connected with one another in series and respectively receive the control signals SW1 to SWP. A first terminal of each of the Nth transistors (e.g., the transistors Q1N, Q2N, . . . and QPN) of each of the switch units 111-1 to 111-P is electrically coupled to the corresponding data line, and a second terminal of each of the Nth transistors of each of the switch units 111-1 to 111-P is electrically coupled to the other transistors (e.g., the transistors Q11 to Q1N−1, . . . and QP1 to QPN−1) of the first to the Nth transistors except for the Nth transistors. Moreover, the transistors may be N-type or P-type oxide transistors, which construe no limitations to the invention. Taking the switch unit 111-1 as an example, in the data transmission period T, the transistors Q11 to Q1N are turned off in a sequence from the first transistor to the Nth transistor (correspondingly, in FIG. 1B, the control signals SW1 to SWP are set to have the second voltage in sequence in the data transmission period T).

Furthermore, the switch unit 111-1 includes the transistors Q11 to Q1N, the switch unit 111-2 includes the transistor Q21 to Q2N, and the switch unit 111-3 includes the transistor Q31 to Q3N and so on. The switch unit 111-P includes the transistors QP1 to QPN. Regarding the first switch unit 111-1, the Nth transistor therein is the transistor Q1N, the first terminal of the transistor Q1N is electrically coupled to the data line L1, the second terminal of the transistor Q1N is electrically coupled to the transistors Q1N−1 to Q11 which are coupled in series, and the transistor Q1N is electrically coupled to the source driver 10 through the transistors Q1N−1 to Q11. After the switch units 111-1 to 111-P collectively receive the data voltage Data_in, the data voltage Data_in is transmitted to the corresponding data line among the data lines L1 to LP through the first to the Nth transistors of the switch units 111-1 to 111-P.

When the switch units 111-1 to 111-P are turned on, the N transistors in the turned-on switch units (e.g., 111-1 to 111-P) are respectively turned on according to the control signals SW1 to SWP to transmit the data voltage Data_in to the corresponding data lines (e.g., the data lines L1 to LP). In contrary, when the switch units 111-1 to 111-P are turned off, at least one of the N transistors in the turned-off switch units (e.g., 111-1 to 111-P) is turned off according to the corresponding control signal. Therein, N is equal to P−1, and P is an integer greater than 2. When the transistors in the switch units 111-1 to 111-P are N-type oxide transistors, in the data transmission period of the demultiplexer circuit 110, a time length of each of the control signals SW1 to SWP having the first voltage is greater than or equal to a time length having the second voltage, where the first voltage is greater than the second voltage, the first voltage serves to turn on the N-type oxide transistors, and the second voltage serves to turn off the N-type oxide transistors. The first voltage is, for example, a positive voltage, while the second voltage is a zero voltage or a negative voltage. On the other hand, when the transistors in the switch units 111-1 to 111-P are P-type oxide transistors, in the data transmission period of the demultiplexer circuit 110, the period of each of the control signals SW1 to SWP having the second voltage is greater than the period having the first voltage, where the first voltage is greater than the second voltage, the first voltage serves to turn off the P-type oxide transistors, and the second voltage serves to turn on the P-type oxide transistors. The first voltage is, for example, a positive or a zero voltage, while the second voltage is a negative voltage.

The operation process of the demultiplexer circuit 110 will be described in detail with reference to FIG. 1 A and FIG. 1B. When the transistors Q11 to Q1N are N-type oxide transistors, the control signals SW1 to SWP are set to have the first voltage as default and set to have the second voltage in sequence in the data transmission period, where the period of each of the control signals SW1 to SWP having the second voltage does not overlap with one another. Among the switch units 111-1 to 111-P, a jth transistor of an ith switch unit receives a kth control signal. When a remainder after (i+j) is divided by P is not equal to 0, k is equal to the remainder after (i+j) is divided by P, and when the remainder after (i+j) is divided by P is equal to 0, k is equal to P, where i, j and k are positive integers.

For instance, assumed that N is equal to P−1, in the first switch unit 111-1, the 1st transistor Q11 (i.e., i=1 and j=1) receives the 2nd control signal SW2 (i.e., the remainder is 2 after (1+1) is divided by P, and namely, k=2), the 2nd transistor Q12 (i.e., i=1 and j=2) receives the 3rd control signal SW3 (i.e., the remainder is 3 after (1+2) is divided by P) and so on, likewise. The Nth transistor Q1N (i.e., i=1 and j=P−1) receives the Pth control signal SWP (i.e., the remainder is 0 after (1+P−1) is divided by P). In the second switch unit 111-2, the 1st transistor Q21 (i.e., i=2 and j=1) receives the 3rd control signal SW2 (i.e., the remainder is 3 after (2+1) is divided by P), the 2nd transistor Q22 (i.e., i=2 and j=2) receives the 4th control signal SW2 (i.e., the remainder is 4 after (2+2) is divided by P) and so on, likewise. The (N−1)th transistor Q2N−1 (i.e., i=2 and j=P−1−1) receives the Pth control signal SWP (i.e., the remainder is 0 after (2+P−1−1) is divided by P), and the Nth transistor Q2N (i.e., i=2 and j=P−1) receives the 1st control signal SW1 (i.e., the remainder is 1 after (2+P−1) is divided by P). The description regarding the rest may be learned with reference to the illustration of FIG. 1A and will not be repeated hereinafter.

In the switch unit 111-1, a plurality of control terminals of the transistors Q11 to Q1N receives the control signals SW2 to SWN. In other words, the transistors Q11 to Q1N in the switch unit 111-1 does not receive the control signal SW1. Meanwhile, the transistor Q21 to Q2N in the switch unit 111-2 does not receive the control signal SW2. The description regarding the rest may be learned with reference to the illustration of FIG. 1A and will not be repeated hereinafter. The data voltage Data_in may have data voltages from Data_1 to Data_N in sequence, and levels of the data voltages Data_1 to Data_N may be designed according to actual requirements, which are not limited in the invention.

For instance, when the demultiplexer circuit 110 is about to transmit the data voltage Data_1 to the data line L1, all of the transistors Q11 to Q1N in the switch unit 111-1 are turned on so that the data voltage Data_1 is transmitted to the data line L1 through the switch unit 111-1, while the control signal SW1 is set to have the second voltage, and the control signals SW2 to SWP are all set to have the first voltage. In this case, the transistor Q21 to Q2N−1 in the switch unit 111-2 are turned on, but the transistor Q2N is not turned on under the control of the control signal SW1.

Thereafter, when the demultiplexer circuit 110 is about to transmit the data voltage Data_2 to the data line L2, all of the transistor Q21 to Q2N in the switch unit 111-2 are turned on so that the data voltage Data_2 is transmitted to the data line L2 through the switch unit 111-2, while the control signal SW2 is set to have the second voltage, and the control signals SW1 and SW3 to SWP are all set to have the first voltage.

Additionally, since a control terminal of the transistor Q2N in the switch unit 111-2 receives the control signal SW1, the transistor Q11 in this case is turned off, but the transistor Q21 to Q2N−1 are turned on. Thus, the data voltages Data_1 and Data_3 to Data_p are not stored in the switch unit 111-2, and thereby, an error of writing the wrong data voltage can be avoided. Likewise, when the demultiplexer circuit 110 is about to transmit the data voltage Data_P to the data line LP, all of the transistors QP1 to QPN in the switch unit 111-P are turned on so that the data voltage Data_P is transmitted to the data line LP through the switch unit 111-P, while the control signal SWP is set to have the second voltage, and the control signals SW1 to SWP−1 are all set to have the first voltage.

On the other hand, when the transistors in the switch units 111-1 to 111-P are P-type oxide transistors, the control signals SW1 to SWP may set to have the second voltage as default, set to have the first voltage in sequence in the data transmission period, and the period of each of the control signals SW1 to SWP having the second voltage does not overlap with one another. The operation manner in a scenario where the transistors in the switch units 111-1 to 111-P are P-type oxide transistors are similar to the above-description and thus, will not be repeatedly described below. Based on the above description, in the period of the demultiplexer circuit 110 of the invention transmitting the data voltage Data_in, a turned-on period of each of the transistors (e.g., Q11 to Q1N, . . . and QP1 to QPN) of the switch units 111-1 to 111-P is greater than or equal to a turned-off period. Accordingly, stress due to the transistors of the demultiplexer circuit 110 being turned off can be mitigated.

Figure 2A:
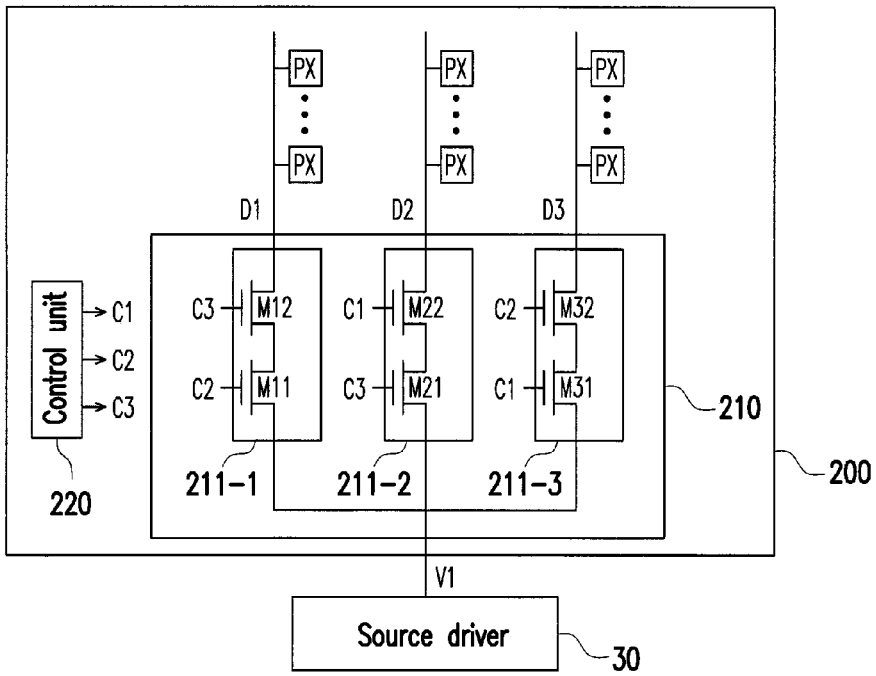
FIG. 2A is a schematic circuit diagram illustrating a display panel according to another embodiment of the invention.

FIG. 2A is a schematic circuit diagram illustrating a display panel according to another embodiment of the invention.

Referring to FIG. 1A and FIG. 2A, therein, the same or like parts use the same reference numbers in the drawings and the description. In the present embodiment, a display panel 200 includes a plurality of pixels PX, a plurality of data lines D1 to D3, a demultiplexer circuit 210 and a control unit 220. The data lines D1 to D3 are electrically coupled to the corresponding pixels PX respectively, and the demultiplexer circuit 210 is electrically coupled to the data lines D1 to D3. The demultiplexer circuit 210 is configured to transmit a data voltage V1 provided by the source driver 30 to the data lines D1 to D3, and the control unit 220 is configured to generate a plurality of control signals C1 to C3 (corresponding to a first to a third control signals) to control a transmission state of the demultiplexer circuit 210. The demultiplexer circuit 210 includes a first to a third switch units 211-1 to 211-3. The switch units 211-1 to 211-3 are electrically coupled to the data lines D1 to D3 respectively and collectively receive the data voltage V1 provided by the source driver 30. The switch units 211-1 to 211-3 are also turned on in sequence in the data transmission period to provide the data voltage V1 to the data lines D1 to D3 in sequence.

Each of the switch units 211-1 to 211-3 includes two serially coupled transistors (e.g., transistors M11 to M12, transistors M21 to M22 and transistors M31 to M32), and the transistors respectively receive the control signals C1 to C3. The transistors M11 and M12 of the switch unit 211-1 respectively receive the control signals C2 and C3, the transistors M21 and M22 of the switch unit 211-2 respectively receive the control signals C3 and C1, and the transistors M31 and M32 of the switch unit 211-3 respectively receive the control signals C1 and C2. All of the transistors are implemented as N-type oxide transistors for the purpose of example; however, in other embodiments, the transistors may be implemented in forms of P-type oxide transistors, which are not limited in the invention. Additionally, the demultiplexer circuit 210 may be considered as the demultiplexer circuit 110 of FIG. 1A set in the condition that P is equal to 3, and N is equal to 2.

Figure 2B:
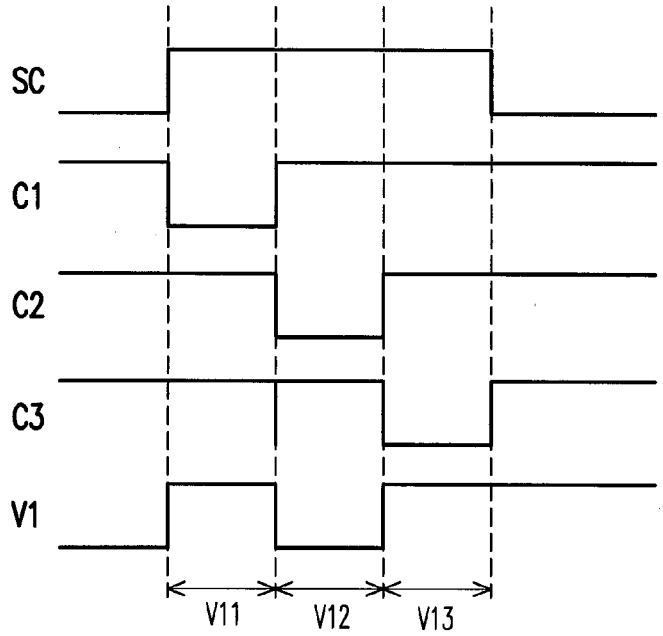
FIG. 2B is a schematic diagram illustrating a drive waveform of the demultiplexer circuit depicted in FIG. 2A.

FIG. 2B is a schematic diagram illustrating a drive waveform of the demultiplexer circuit depicted in FIG. 2A. The operation process of the demultiplexer circuit 200 will be described in detail with reference to FIG. 2A and FIG. 2B. Meanwhile, in FIG. 2B, a scan signal SC is at a high level in the data transmission period to turn on the corresponding pixels of the display panel 200. When the demultiplexer circuit 210 is about to transmit the data voltage V1 at a voltage level corresponding to a first period V11 to the data line D1, both the control signals C2 and C3 are set to have the first voltage, while the control signal C1 is set to have the second voltage. Thus, both the transistors M11 to M12 in the switch unit 211-1 are turned on, and thus, the voltage level in the first period V11 is transmitted to the data line D1 through the switch unit 211-1. Then, when the demultiplexer circuit 210 is about to transmit the data voltage V1 at a second voltage level corresponding to a second period V12 to the data line D2, both the control signals C1 and C3 are set to have the first voltage, while the control signal C2 is set to have the second voltage. Thus, both the transistors M21 to M22 in the switch unit 211-2 are turned on, and the voltage level corresponding to the second period V12 is transmitted to the data line D2 through the switch unit 211-2. Finally, when the demultiplexer circuit 210 is about to transmit the data voltage V1 at a voltage level corresponding to a third period V13 to the data line D3, both the control signals C1 and C2 are set to have to the first voltage, while the control signal C3 is set to have the second voltage. Thus, both the transistors M31 to M32 in the switch unit 211-3 are turned on, and the voltage level corresponding to the third period V13 is transmitted to the data line D3 through the switch unit 211-3. Moreover, in the present embodiment, the voltage levels set for the data voltage V1 are only an exemplary illustration, and the invention is not limited thereto.

Figure 2C:
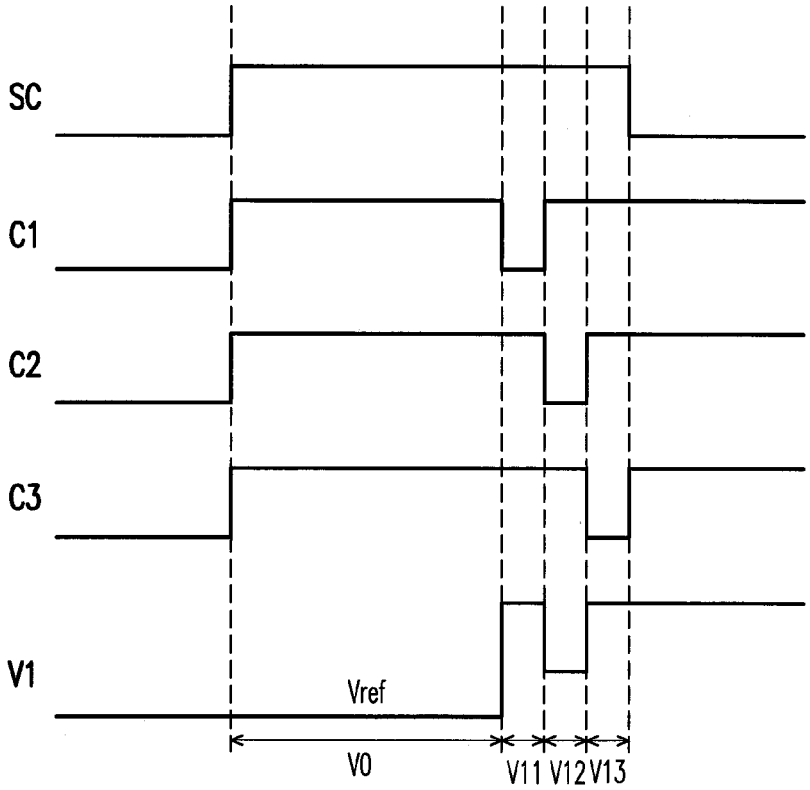
FIG. 2C is a schematic diagram illustrating another drive waveform of the demultiplexer circuit depicted in FIG. 2A.

In FIG. 2A, the display panel 200 may be a liquid crystal display (LCD) panel. In other embodiments, the display panel 200 may be an organic light-emitting diode (OLED) display panel. Thus, FIG. 2C is a schematic diagram illustrating a drive waveform in a scenario where the demultiplexer circuit depicted in FIG. 2A is applied to an OLED display panel. Referring to FIG. 2A and FIG. 2C, all of the control signals C1 to C3 have the first voltage when the data voltage V1 is in a compensation period V0, such that a reference voltage Vref is written to compensate a threshold voltage Vth of the transistors, and the control signals C1 to C3 are set to have the second voltage in sequence respectively during the first to the third periods V11 to V13 when a data writing operation using the data voltage V1 is performed. Thereby, the switch units 211-1 to 211-3 are turned on in sequence to respectively transmit the data voltages of the data voltage V1 corresponding to the first to the third periods V11 to V13 to the data lines D1 to D3. Based on the description above, during the period of the demultiplexer circuit 210 of the invention transmitting the data voltage V1, a time length of the transistors in the switch units 211-1 to 211-3 being turned on is greater than or equal to a time length of being turned off. Accordingly, stress due to the transistors (e.g., M11 to M12, M21 to M22 and M31 to M32) of the demultiplexer circuit 210 being turned off can be mitigated.

In the display panel 200, a terminal of each of the transistors M11 to M12, M21 to M22 and M31 to M32 may be considered as an equivalent capacitor and namely, has a charge storage capability. Taking the switch unit 211-1 as an example, if the transistors M11 to M12 are not turned off in sequence (i.e., if the transistor M11 receives the control signal C3 while the transistor M12 receives the control signal C2), even though the data voltage V11 may still be transmitted to the data line D1 in a first time interval of the data transmission period (when the switch unit 211-1 is turned on, while the switch units 211-2 and 211-3 are turned off), in a second interval of the data transmission period (when the switch unit 211-2 is turned on while the switch units 211-1 and 211-3 are turned off), the data voltage V12 may be transmitted to and stored in parasitic capacitors between the transistor M11 and the transistor M12 due to the transistor M12 being turned on. As a result, in a third interval of the data transmission period (when the switch unit 211-3 is turned on while the switch units 211-1 and 211-2 are turned off), the data voltage V12 previously stored in the parasitic capacitors between the transistor M11 and the transistor M12 is transmitted to the data line D1 due to the transistor M12 being turned on. Thus, in the present embodiment, each of the transistors (e.g., the transistors M11 to M12) of the switch unit 211-1 are turned off in sequence according to the control signals C2 and C3 so as to prevent the data voltage V12 from mistakenly written into the non-corresponding pixels.

Figure 3A:
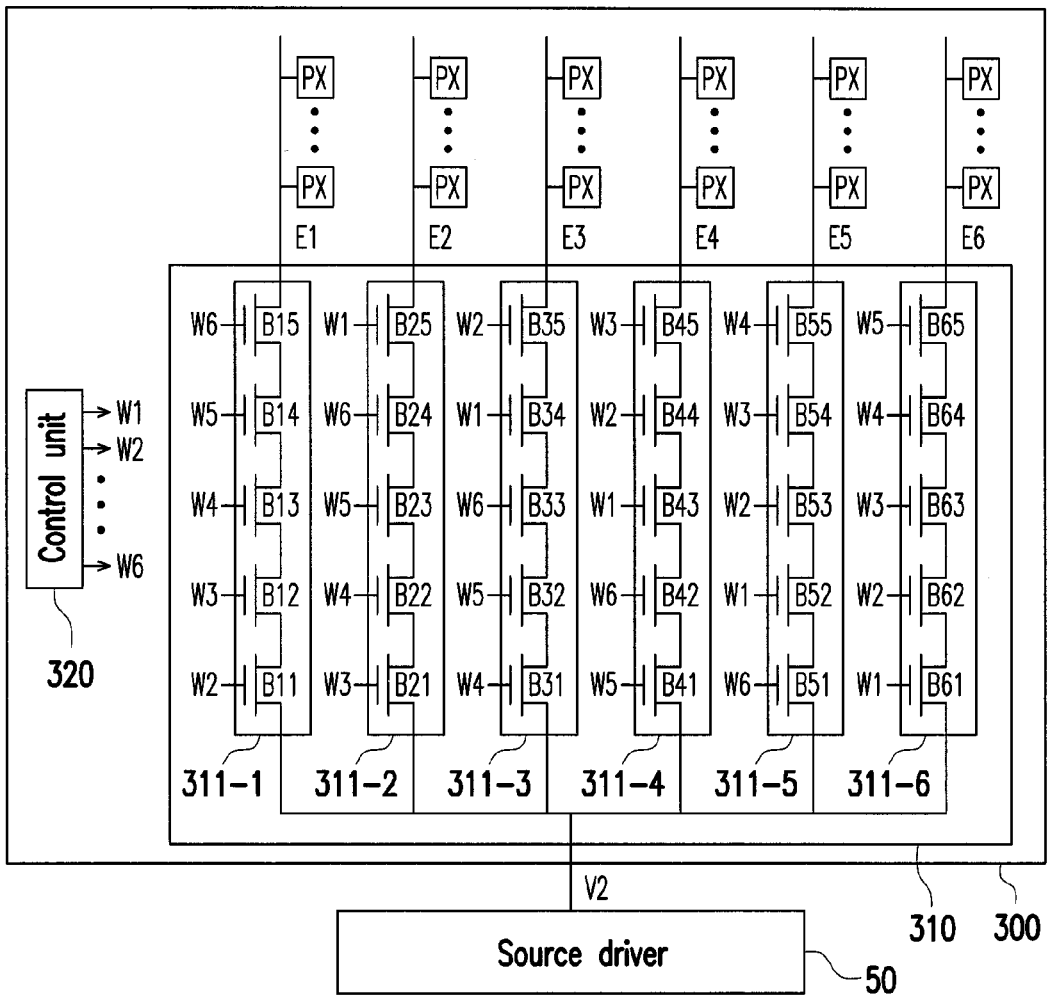
FIG. 3A is a schematic circuit diagram illustrating a display panel according to yet another embodiment of the invention.

FIG. 3A is a schematic circuit diagram illustrating a display panel according to yet another embodiment of the invention. Referring to FIG. 1A and FIG. 3A, therein, the same or like parts use the same reference numbers in the drawings and the description. In the present embodiment, a display panel 300 includes a plurality of pixels PX, includes a plurality of data lines E1 to E6, a demultiplexer circuit 310 and a control unit 320. The data lines E1 to E6 are electrically coupled to the corresponding pixels PX respectively, the demultiplexer circuit 310 is electrically coupled to the data lines E1 to E6. The demultiplexer circuit 310 is configured to transmit a data voltage V2 provided by the source driver 50 to the data lines E1 to E6, and the control unit 320 is configured to generate a plurality of control signal W1 to W6 (corresponding to a first to a sixth control signals) to control a transmission state of the demultiplexer circuit 310. The demultiplexer circuit 310 includes a first to a sixth switch units 311-1 to 311-6. The switch units 311-1 to 311-6 are electrically coupled to the data lines E1 to E6 and collectively receive the data voltage V2 of the source driver 50. The switch units 311-1 to 311-6 are turned on in sequence in the data transmission period to provide the data voltage V2 to the data lines E1 to E6.

Each of the switch units 311-1 to 311-6 includes five serially coupled transistors (e.g., B11 to B15, . . . and B61 to B65), and the transistors respectively receive the control signals W1 to W6. The transistors B11 to B15 of the switch unit 311-1 receive the control signals W2 to W6 in sequence, the transistors B21 to B25 of the switch unit 311-2 receive the control signals W3 to W6 and the 1st control signal W1 in sequence, the transistors B31 to B35 of the switch unit 311-3 receive the control signals W4 to W6 and W1 to W2 in sequence, the transistors B41 to B45 of the switch unit 311-4 receives the control signals W5 to W6 and W1 to W3 in sequence, the transistors B51 to B55 of the switch unit 311-5 receive the control signals W6 and W1 to W4 in sequence, and the transistors B61 to B65 of the switch unit 311-6 receive the control signals W1 to W5 in sequence. Additionally, the demultiplexer circuit 310 may be considered as the demultiplexer circuit 110 of FIG. 1A set in the condition that P is equal to 6, and N is equal to 5.

Figure 3B:
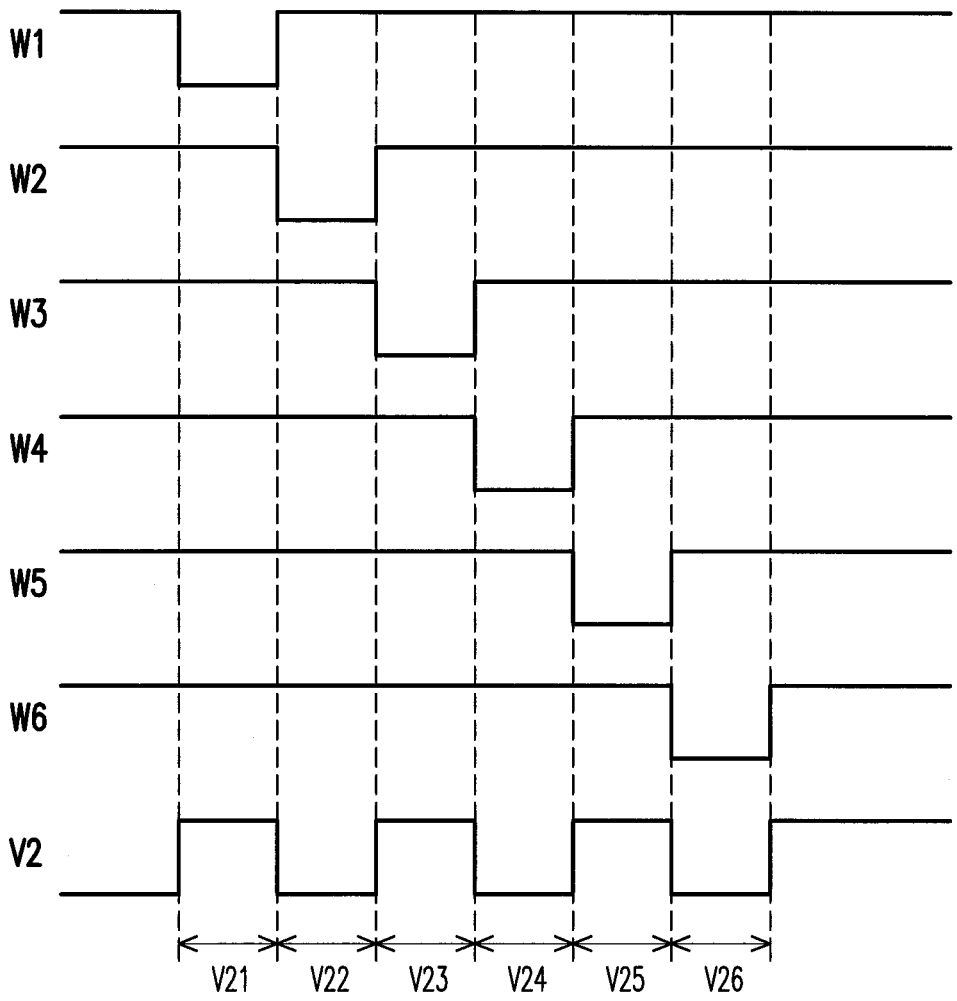
FIG. 3B is a schematic diagram illustrating a drive waveform of the demultiplexer circuit depicted in FIG. 3A.

FIG. 3B is a schematic diagram illustrating a drive waveform of the demultiplexer circuit depicted in FIG. 3A. The operation process of the demultiplexer circuit 300 will be described in detail with reference to FIG. 3A and FIG. 3B. When the demultiplexer circuit 310 is about to transmit the data voltage V2 at a voltage level corresponding to a first period V21 to the data line E1, all of the control signals W2 to W6 are set to have the first voltage, while the control signal W1 is set to have the second voltage. Thus, the transistors B11 to B15 in the switch unit 311-1 are all turned on, and the voltage level corresponding to the first period V21 is transmitted to the data line E1 through the switch unit 311-1. Likewise, when the demultiplexer circuit 310 is about to transmit the data voltage V2 at a voltage level corresponding to a sixth period V26, all of the control signals W1 to W5 are set to have the first voltage while the control signal W6 is set to have the second voltage. Thus, the transistors B61 to B65 in the switch unit 311-6 are all turned on, and the voltage level corresponding to the sixth period V26 is transmitted to the data line E6 through the switch unit 311-6. Moreover, in the present embodiment, the voltage levels set for the data voltage V2 only an exemplary illustration, and the invention is not limited thereto. Based on the description above, during the period of the demultiplexer circuit 310 of the invention transmitting the data voltage V2, a time length of the transistors (e.g., B11 to B15, . . . and B61 to B65) in the switch units 311-1 to 311-6 being turned on is greater than or equal to a time length of being turned off. Accordingly, stress due to the transistors of the demultiplexer circuit 310 being turned off can be mitigated.

In the display panel 300, a terminal of each of the transistors B11 to B15, B21 to B25, B31 to B35, B41 to B55, B51 to B55 and B61 to B65 may be considered as an equivalent capacitor and namely, has a charge storage capability. Taking the switch unit 311-1 as an example, if the transistors B11 to B15 are not turned off in sequence, the switch unit 311-1 may store the data voltage V2 that is not transmitted in the corresponding periods (e.g., the period V22s to V26), which results in the data voltage V2 mistakenly transmitted to the data line E1. Thus, in the present embodiment, the transistors (e.g., B11 to B15, . . . and B61 to B65) of each of the switch units 311-1 to 311-6 are turned off in sequence according to the control signals W1-W6 respectively so as to prevent the data voltage V2 from being mistakenly stored in the switch units 311-1 to 311-6 and to prevent the data voltage V2 from being mistakenly written into non-corresponding data lines (e.g., E1 to E6).

To sum up, in the display panel and the demultiplexer circuit thereof according to the embodiments of the invention, the control signals are re-designed the control signals are reconfigured as the periods having the first voltage or the second voltage, and the circuit structure of the demultiplexer circuit is correspondingly reconfigured, such that a time length of the transistors in the demultiplexer circuit being turned on is greater than or equal to a time length of the transistors in the demultiplexer circuit being turned off. Accordingly, stress due to the transistors of the demultiplexer circuit being turned off can be mitigated. On the other hand, the display panel and the demultiplexer circuit thereof of the invention can facilitate in dramatically reducing pin numbers of IC chips in the source driver so as to reduce manufacturing cost and volumes of the IC chips.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A demultiplexer circuit, adapted to transmit a data voltage provided by a source driver to a first to a Pth data lines of a display panel, the demultiplexer circuit comprising:

a first to a Pth switch units, respectively electrically coupled to the first to the Pth data lines of the display panel and configured to collectively receive the data voltage, wherein the first to the Pth switch units are turned on in sequence to provide the data voltage to the corresponding data lines, and a period of the data voltage being provided to the first to the Pth data lines in sequence is defined as a data transmission period, wherein, each of the switch units comprises a first to a Nth transistors, the N transistors are connected with one another in series and configured to receive a plurality of control signals, wherein when the switch units are turned on, the N transistors are further configured to be turned on according to the control signals to transmit the data voltage to the corresponding data lines, and when the switch units are turned off, at least one of the N transistors is further configured to be turned off according to the corresponding control signal, wherein N is equal to P−1, and P is an integer greater than 2, and in the data transmission period, a time length of each of the control signals having a first voltage is greater than or equal to a time length of each of the control signals having a second voltage, and the first voltage is greater than the second voltage.

2. The demultiplexer circuit according to claim 1, wherein the first to the Pth switch units is configured for collectively receiving the data voltage and being turned on in sequence to provide the data voltage to the corresponding data lines, each of the switch units are configured to transmit the data voltage through the first to the Nth transistors in sequence and provide the data voltage to the corresponding data line.

3. The demultiplexer circuit according to claim 2, wherein in the data transmission period, the first to the Nth transistors of the first switch unit are turned off in a sequence from the first to the Nth transistors.

4. The demultiplexer circuit according to claim 3, wherein the control signals received by each of the switch units comprises a first to a Pth control signals, the first to the Pth control signals are set to have the first voltage as default and are set to have the second voltage in sequence in the data transmission period, and periods for the first to the Pth control signals having the second voltage do not overlap.

5. The demultiplexer circuit according to claim 4, wherein a jth transistor of an ith switch unit is configured to receive a kth control signal, when a remainder after i+j is divided by P is not equal to 0, k is equal to the remainder after i+j is divided by P, and when the remainder after i+j is divided by P is equal to 0, k is equal to P, wherein i, j and k are respectively integers.

6. The demultiplexer circuit according to claim 5, wherein P is equal to 3, N is equal to 2, wherein the first and the second transistors of the first switch unit respectively receive the second and the third control signals, the first and the second transistors of the second switch unit respectively receive the third and the first control signals, and the first and the second transistors of the third switch unit respectively receive the first and the second control signals.

7. The demultiplexer circuit according to claim 5, wherein P is equal to 6, N is equal to 5, wherein the first to the fifth transistors of the first switch unit respectively receive the second to the sixth control signals, the first to the fifth transistors of the second switch unit respectively receive the third to the sixth and the first control signals, the first to the fifth transistors of the third switch unit respectively receive the fourth to the sixth and the first to the second control signals, the first to the fifth transistors of the fourth switch unit respectively receive the fifth to the sixth and the first to the third control signals, the first to the fifth transistors of the fifth switch unit respectively receive respectively receive the sixth and the first to the fourth control signals, and the first to the fifth transistors of the sixth switch unit receive the first to the fifth control signals in sequence.

8. The demultiplexer circuit according to claim 2, wherein the control signals received by each of the switch units comprises a first to a Pth control signals, the first to the Pth control signals are set to have the first voltage as default and are set to have the second voltage in sequence in the data transmission period, and periods for the first to the Pth control signals having the second voltage do not overlap.

9. The demultiplexer circuit according to claim 8, wherein a jth transistor of an ith switch unit is configured to receive a kth control signal, when a remainder after i+j is divided by P is not equal to 0, k is equal to the remainder after i+j is divided by P, and when the remainder after i+j is divided by P is equal to 0, k is equal to P, wherein i, j and k are respectively integers.

10. The demultiplexer circuit according to claim 9, wherein P is equal to 3, N is equal to 2, wherein the first and the second transistors of the first switch unit respectively receive the second and the third control signals, the first and the second transistors of the second switch unit respectively receive the third and the first control signals, and the first and the second transistors of the third switch unit respectively receive the first and the second control signals.

11. The demultiplexer circuit according to claim 9, wherein P is equal to 6, N is equal to 5, wherein the first to the fifth transistors of the first switch unit respectively receive the second to the sixth control signals, the first to the fifth transistors of the second switch unit respectively receive the third to the sixth and the first control signals, the first to the fifth transistors of the third switch unit respectively receive the fourth to the sixth and the first to the second control signals, the first to the fifth transistors of the fourth switch unit respectively receive the fifth to the sixth and the first to the third control signals, the first to the fifth transistors of the fifth switch unit respectively receive respectively receive the sixth and the first to the fourth control signals, and the first to the fifth transistors of the sixth switch unit receive the first to the fifth control signals in sequence.

12. A display panel, comprising:

a plurality of pixels;

a plurality of data lines, electrically coupled to the plurality of pixels;

a demultiplexer circuit, electrically coupled to the plurality of data lines, comprising:

a first to a Pth switch units, respectively electrically coupled to the first to the Pth data lines of the display panel and configured to collectively receive the data voltage, wherein the first to the Pth switch units are turned on in sequence to provide the data voltage to the corresponding data lines, and a period of the data voltage being provided to the first to the Pth data lines in sequence is defined as a data transmission period, wherein each of the switch units comprises a first to a Nth transistors, the N transistors are connected with one another in series and configured to receive a plurality of control signals, wherein when the switch units are turned on, the N transistors are further configured to be turned on simultaneously according to the control signals to transmit the data voltage to the corresponding data lines, and when the switch units are turned off, at least one of the N transistors is further configured to be turned off according to the corresponding control signal, wherein N is equal to P−1, and P is an integer greater than 2, and in the data transmission period, a time length of each of the control signals having a first voltage is greater than or equal to a time length of each of the control signals having a second voltage, and the first voltage is greater than the second voltage; and a control unit, configured to generate the control signals.

13. The display panel circuit according to claim 12, wherein the first to the Pth switch units is configured for collectively receiving the data voltage and being turned on in sequence to provide the data voltage to the corresponding data lines, each of the switch units are configured to transmit the data voltage through the first to the Nth transistors in sequence and provide the data voltage to the corresponding data line.

14. The display panel circuit according to claim 13, wherein in the data transmission period, the first to the Nth transistors of the first switch unit are turned off in a sequence from the first to the Nth transistors.

15. The display panel circuit according to claim 13, wherein the control signals received by each of the switch units comprises a first to a Pth control signals, the first to the Pth control signals are set to have the first voltage as default and are set to have the second voltage in sequence in the data transmission period, and periods for the first to the Pth control signals having the second voltage do not overlap.

16. The display panel according to claim 15, wherein a jth transistor of an ith switch unit is configured to receive a kth control signal, when a remainder after i+j is divided by P is not equal to 0, k is equal to the remainder after i+j is divided by P, and when the remainder after i+j is divided by P is equal to 0, k is equal to P, wherein i, j and k are respectively integers.

17. The display panel according to claim 16, wherein P is equal to 3, N is equal to 2, wherein the first and the second transistors of the first switch unit respectively receive the second and the third control signals, the first and the second transistors of the second switch unit respectively receive the third and the first control signals, and the first and the second transistors of the third switch unit respectively receive the first and the second control signals.

18. The display panel according to claim 16, wherein P is equal to 6, N is equal to 5, wherein the first to the fifth transistors of the first switch unit respectively receive the second to the sixth control signals, the first to the fifth transistors of the second switch unit respectively receive the third to the sixth and the first control signals, the first to the fifth transistors of the third switch unit respectively receive the fourth to the sixth and the first to the second control signals, the first to the fifth transistors of the fourth switch unit respectively receive the fifth to the sixth and the first to the third control signals, the first to the fifth transistors of the fifth switch unit respectively receive respectively receive the sixth and the first to the fourth control signals, and the first to the fifth transistors of the sixth switch unit receive the first to the fifth control signals in sequence.

19. A demultiplexer circuit, adapted to transmit a data voltage provided by a source driver to a first to a Pth data lines of a display panel, the demultiplexer circuit comprising:

a first to a Pth switch units, respectively electrically coupled to the first to the Pth data lines of the display panel and configured to collectively receive the data voltage, wherein the first to the Pth switch units are turned on in sequence to provide the data voltage to the corresponding data lines, and a period of the data voltage being provided to the first to the Pth data lines in sequence is defined as a data transmission period, each of the switch units comprises a first to a Nth transistors, the first and the Nth transistors are connected with one another in series from the source driver to the corresponding data lines and configured to receive a plurality of control signals, wherein when the switch units are turned on, the N transistors are further configured to be turned on according to the control signals to transmit the data voltage to the corresponding data lines, and when the switch units are turned off, at least one of the N transistors is further configured to be turned off according to the corresponding control signal, wherein N is equal to P−1, and P is an integer greater than 2, and in the data transmission period, the first to the Nth transistors of the first switch unit are turned off in a sequence from the first to the Nth transistors.

20. The demultiplexer circuit according to claim 19 wherein the control signals received by each of the switch units comprises a first to a Pth control signals, the first to the Pth control signals has a first voltage as default and are set to have the second voltage in sequence in the data transmission period, and periods for the first to the Pth control signals having the second voltage do not overlap.

* * * * *